United States Patent [19]

Borrow

[11] Patent Number: 4,589,946

[45] Date of Patent: May 20, 1986

[54] PACKAGING APPARATUS

[76] Inventor: Edgar W. Borrow, Padnell Grange, Cowplain, Portsmouth, Hampshire, England

[21] Appl. No.: 641,850

[22] Filed: Aug. 17, 1984

[30] Foreign Application Priority Data

Aug. 19, 1983 [GB] United Kingdom ..... 8322435

[51] Int. Cl.[4] ..... B32B 31/10; B32B 31/18

[52] U.S. Cl. ..... 156/513; 53/397; 53/462; 53/542; 53/580; 53/591; 156/252; 156/301; 156/304.3; 156/552; 156/555; 156/562

[58] Field of Search ..... 156/252, 301, 304.3, 156/513, 552, 555, 562; 206/602, 484.2, 820, 611, 3; 53/398, 542, 171, 176, 580, 137, 415, 591, 397, 462

[56] References Cited

U.S. PATENT DOCUMENTS

| | | | |
|---|---|---|---|
| 1,710,393 | 4/1929 | Williams | 53/397 |
| 2,379,934 | 7/1945 | Seferth | 206/820 |
| 2,456,059 | 12/1948 | Grupe | 53/580 |
| 2,512,579 | 6/1950 | Long | 156/552 |
| 2,925,946 | 2/1960 | Graver | 53/580 |
| 3,071,244 | 1/1963 | Doran | 206/602 |
| 3,196,591 | 7/1965 | Guido et al. | 53/137 |
| 3,444,993 | 5/1969 | Lunsford | 206/820 |

*Primary Examiner*—Michael Wityshyn
*Attorney, Agent, or Firm*—Leydig, Voit & Mayer, Ltd.

[57] ABSTRACT

Apparatus for securing together rectangular-section cartons (13) in groups of, for example, five cartons comprises tape dispensers (14,14') for dispensing adhesive tape (15*a,b,c*) on to the tops and bottoms of cartons in a row of cartons, and perforating rollers containing pins (21) for perforating the tape with spaced rows of perforations arranged to be located between adjacent cartons, each fifth row containing more perforations and means for breaking the tape at each fifth row to separate the cartons into batches of five.

7 Claims, 2 Drawing Figures

PACKAGING APPARATUS

BACKGROUND OF THE INVENTION

The present invention relates to packaging apparatus and in particular to apparatus for packaging rectangular section cartons such as are currently used for containing plain milk, fluoridated and/or flavoured milk, or fruit beverages and which are commonly marketed with a drinking straw attached to the outside of the carton.

It is known to envelope containers in plastics sheeting, for example heat-shrinkable sheeting, but such packaging material is not very satisfactory for holding together the relatively lightweight cartons used for containing milk and fruit beverages. Moreover such an envelope is not easily opened, and does not lend itself to securing together small numbers of cartons in a readily detachable manner.

It is also known from UK-A No. 1403 270 to provide a carrier for cylindrical cans, each having a flange at one end, which takes the form of a plastics strip formed with two rows of apertures, the material surrounding each aperture forming a collar adapted to fit over the flanged upper end of a can, with slits of different lengths preformed in the plastics material between adjacent collars of a row to facilitate parting of the cans from one another. Such a carrier however is not suitable for packaging rectangular section cartons.

BRIEF SUMMARY OF THE INVENTION

According to the present invention there is provided apparatus for securing together rectangular section cartons in batches characterised by means along which the cartons can be moved in a row and means for dispensing adhesive tape into contact with two opposite sides of the cartons which extend along the row of cartons.

The present invention also provides apparatus for securing together rectangular section cartons in batches characterised by a dispenser for adhesive tape and means for perforating the tape at a first set of spaced positions along the tape sufficient to permit the tape to break between batches when subjected to a first predetermined strain and at a second set of spaced positions sufficiently to permit the tape to break between individual cartons when subjected to a second predetermined strain greater than said first strain.

BRIEF DESCRIPTION OF THE DRAWINGS

The invention will now be particularly described, by way of example, with reference to the accompanying drawings in which.

DETAILED DESCRIPTION

Figure 1:
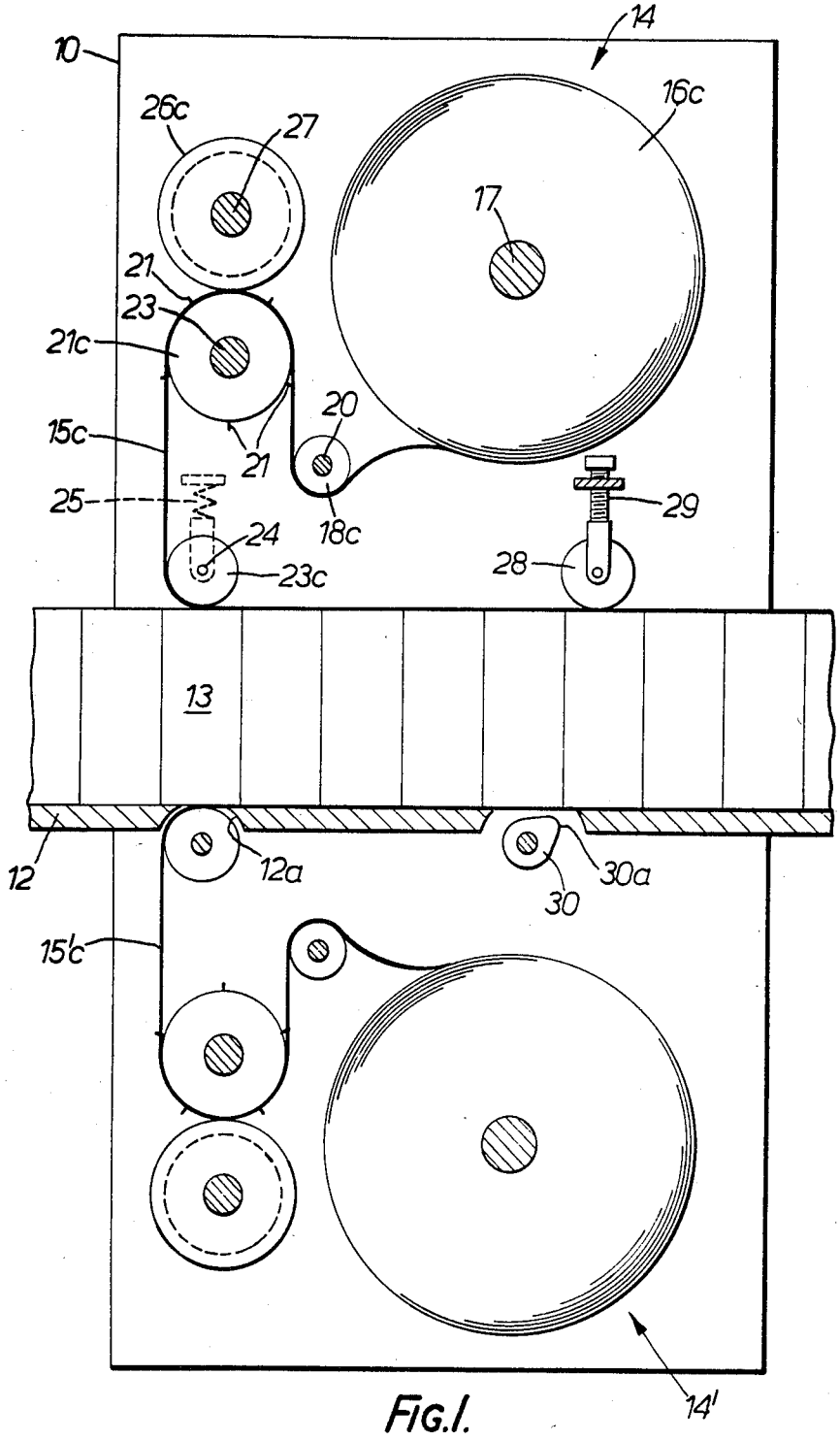
FIG. 1 is a side elevation of packaging apparatus according to the invention.
Figure 2:
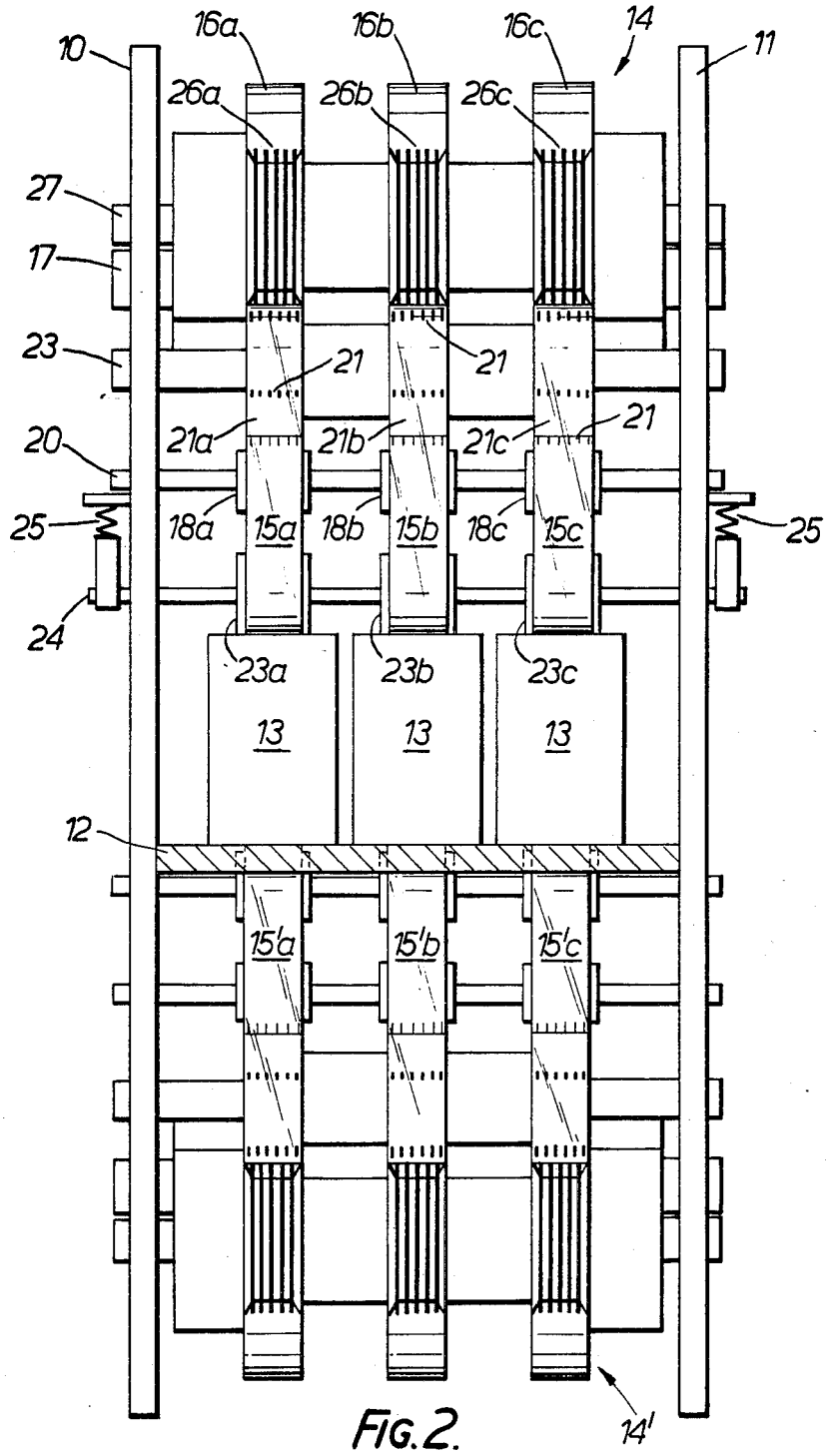
FIG. 2 is a front elevation of the apparatus of FIG. 1.

As shown in the drawings, the apparatus comprises a pair of parallel spaced upright side walls 10,11 between which extends a platform 12 across which three rows of cartons 13 can pass in side-by-side relation, a first set 14 of adhesive plastics tape dispensers disposed above the platform for dispensing three adhesive plastics tapes 15*a*, 15*b*, 15*c* into adhesive engagement with the upper surfaces of cartons 13 passing across the platform, and a second set 14' of similar dispensers disposed below the platform for dispensing three adhesive plastics tapes

15'*a*, 15'*b*, 15'*c* into adhesive engagement with the lower surfaces of the same cartons.

Since the upper set of dispensers is effectively a mirror image of the lower set of dispensers, it will be necessary only to describe the upper set.

The upper set comprises three reels 16*a*, 16*b*, 16*c*, of adhesive plastics tape mounted concentrically with and rotatable on a common shaft 17 journalled in the walls 11,12. A set of three guide rollers 18*a*, 18*b*, 18*c*, mounted on a common shaft 20 journalled in walls 11,12 are arranged to guide the three tapes 15*a*, 15*b*, 15*c* dispensed from the lower portion of the reels, in an upward direction to a set of three perforating rollers 21*a*, 21*b*, 21*c*. These rollers are mounted on a common shaft 23 supported by walls 10,11. The tapes pass over these perforating rollers after which they are guided downwardly and around a set of three further guide rollers 23*a*, 23*b*, 23*c* supported by walls 10,11 on a common shaft 24. The rollers 23*a*, 23*b*, 23*c* are spring biassed, by springs shown diagramatically at 25, to press the adhesive tapes into adherent contact with the upper surfaces of the cartons 13 passing along the platform 12.

The lower set of dispensers 14', whose parts are the same as the corresponding parts of the upper set, have the same references, but with an added suffix. The lower set is arranged to dispense three tapes 15'*a*, 15'*b*, 15'*c* through an opening 12*a* in the platform 12 into adhering contact with the underside of each row of cartons passing along the platform.

The two adhesive tapes sticking respectively to the top surface and bottom surface of each row of cartons secure the cartons together. In order to permit simple separation of cartons, each of the perforating rollers is provided with rows of pins, the rows of pins being spaced apart around the periphery of each roller by distances equal to the distance between alternate cartons in a row. In the illustrated example, there are five rows of pins 21 on each of the perforating rollers 21*a*, 21*b*, 21*c*. Four of the rows of pins contain six pins each and the fifth row contains seven pins, so that the tape is perforated, at each revolution of the perforating rollers, with four rows of six perforations each and a fifth row of seven perforations. Thus a line of extra weakness is formed after each batch of five cartons.

In order to hold the tape against the perforating rollers and to ensure correct perforation of the tape, a set of three vaned rollers 26*a*, 26*b*, 26*c* on a common shaft 27 is pressed against the tapes as they pass over the perforating rollers. The grooves between adjacent vanes of the vaned rollers lie opposite the pins 21 of the perforating rollers so that the vanes hold the tape tightly against the perforating rollers to achieve full penetration of the tape by the pins. In operation of the apparatus, the ends of the six tapes dispensed are caused to adhere to the tops and bottoms of three cartons disposed transversely of the platform, so that as the rows of cartons are advanced, the tapes are pulled off the reels and pressed by the upper guide rollers 23*a*, 23*b*, 23*c* and lower guide rollers against the tops and bottoms of the cartons.

The perforating rollers are synchronised with the flow of cartons, so that the rows of perforations in each tape fall between adjacent cartons. Since every row of perforations provides a line of weakness in the tape, and each fifth row of perforations provides a line of extra weakness, it is easy to break off batches of five cartons, and thereafter, with slightly greater force, break off individual cartons from the batch of five. Although batches of five have been found convenient, different numbers of cartons could be provided in each batch by varying the number of rows of pins in each perforating roller.

One means for breaking the cartons into batches of five comprises a pressure roller 28 arranged to engage the upper surface of the cartons and a cam roller 30 spaced behind the roller 27 by a distance not greater than the distance between alternate cartons in a row. The cam roller 30 is formed with a projection 30*a* and is disposed immediately below the cartons to rotate once during the passage of each five cartons.

Once in each revolution the projection will engage the underside of a carton and lift the carton, and since the carton immediately ahead is held down by the pressure roller 28, the lifting of the first carton in each batch of five cartons will fracture the upper and lower tapes between the last carton of a group of five cartons and the first carton of the next adjacent group.

Once again the number of cartons in a group can be varied by varying the frequency with which the greatest perforation of the tape is formed and by causing the cam roller to lift cartons with the same frequency.

Although reference has been made to the use of six or seven perforating pins in each row, other numbers, depending on the size of the pins, may be suitable.

I claim:

1. Apparatus for securing together rectangular section cartons in batches characterised by a dispenser for adhesive tape and means for perforating the tape at a first set of spaced positions along the tape sufficiently to permit the tape to break between batches when subjected to a first predetermined strain and at a second set of spaced positions sufficiently to permit the tape to break between individual cartons when subjected to a second predetermined strain greater than said first strain.

2. Apparatus according to claim 1 characterised in that the perforating means comprises a roller having rows of pins equidistantly spaced apart around its periphery, the tape being arranged to pass over the roller and be perforated thereby at equally spaced positions along its length.

3. Apparatus according to claim 2 characterised in that one row of pins is arranged to weaken the tape more than each of the other rows.

4. Apparatus according to claim 3 characterised in that said one row of pins contains at least one pin in excess of those in each other row.

5. Apparatus according to claim 3 characterised by a cam operative when a batch of said cartons has passed it, to lift the first carton of the next batch relative to the last carton of the preceding batch and thereby sever the tape between said first and last cartons.

6. Apparatus for securing together rectangular section cartons in batches comprising means along which the cartons can be moved in a row, each carton being in side-by-side contact with the next adjacent carton, means for dispensing adhesive tape into contact with two exposed opposite end surfaces of the cartons which extend along the row of cartons so that the tape extends in two lengths in parallel-spaced relationship to each other and holds adjacent cartons rigidly together, perforating means operative as the adhesive is dispensed to perforate the tape at positions spaced apart along the tape by a distance equal to the distances between successive cartons in said row to form lines of weakness extending across the tape at said spaced-apart positions, and means synchronizing the flow of cartons with the perforation of the tape such that the lines of weakness coincide with the mutually-contacting sides of the cartons and enable the cartons to be separated by pressure applied to the exposed surface of the cartons such as to split the tape along the lines of weakness.

7. Apparatus according to claim 6 wherein said perforating means comprises a roller having rows of pins equidistantly spaced apart around its periphery, said tape being arranged to pass over the roller and be perforated thereby at equally spaced positions along its length.

* * * * *